US009230511B2

(12) United States Patent
Jeon et al.

(10) Patent No.: US 9,230,511 B2
(45) Date of Patent: Jan. 5, 2016

(54) DISPLAY APPARATUS AND DRIVING METHOD THEREOF

(71) Applicant: Samsung Display Co., Ltd., Yongin-City, Gyeonggi-Do (KR)

(72) Inventors: Jae-Gwan Jeon, Incheon (KR); Yong-Bum Kim, Suwon-si (KR); Jaehyoung Park, Suwon-si (KR); Youngsoo Sohn, Guri-si (KR); ByungKil Jeon, Asan-si (KR); Akihiro Takegama, Hwaseong-si (KR); Junpyo Lee, Asan-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 24 days.

(21) Appl. No.: 14/178,669

(22) Filed: Feb. 12, 2014

(65) Prior Publication Data

US 2015/0035875 A1 Feb. 5, 2015

(30) Foreign Application Priority Data

Aug. 1, 2013 (KR) ..... 10-2013-0091339

(51) Int. Cl.
*G09G 5/10* (2006.01)
*G09G 3/36* (2006.01)

(52) U.S. Cl.
CPC ..... *G09G 5/10* (2013.01); *G09G 3/3648* (2013.01); *G09G 2300/0443* (2013.01)

(58) Field of Classification Search
CPC ..... G09G 2300/0443; G09G 5/10
See application file for complete search history.

(56) References Cited

U.S. PATENT DOCUMENTS

| | | | | |
|---|---|---|---|---|
| 2005/0276088 | A1 | 12/2005 | Moon et al. | |
| 2006/0238472 | A1* | 10/2006 | Lee et al. | 345/89 |
| 2008/0136761 | A1* | 6/2008 | Hong et al. | 345/89 |
| 2009/0140964 | A1* | 6/2009 | Chiang | 345/87 |
| 2009/0289968 | A1* | 11/2009 | Yoshida | 345/691 |
| 2010/0123739 | A1* | 5/2010 | Kim et al. | 345/690 |
| 2011/0141088 | A1 | 6/2011 | Jeon | |

FOREIGN PATENT DOCUMENTS

| | | | |
|---|---|---|---|
| KR | 1020050055252 | A | 6/2005 |
| KR | 1020080000099 | A | 1/2008 |
| KR | 1020080011854 | A | 2/2008 |
| KR | 1020080017598 | A | 2/2008 |
| KR | 1020080026718 | A | 3/2008 |
| KR | 1020100055880 | A | 5/2010 |
| KR | 1020110071384 | A | 6/2011 |

* cited by examiner

*Primary Examiner* — Ram Mistry
(74) *Attorney, Agent, or Firm* — Cantor Colburn LLP

(57) ABSTRACT

A display apparatus includes a plurality of pixels connected to a plurality of gate lines and a plurality of data lines and a timing controller, in which each pixel includes a first sub-pixel and a second sub-pixel. In such a display apparatus, the timing controller provides the first sub-pixel and the second sub-pixel with a first data signal and a second data signal corresponding to one of a high gray scale curve and a low gray scale curve, alternately every frame, when the image signal is a first type of image signal, and the timing controller provides the first sub-pixel with a first data signal corresponding to the high gray scale curve and the second sub-pixel with a second data signal corresponding to the low gray scale curve when the image signal is a first type of image signal.

15 Claims, 13 Drawing Sheets

DISPLAY APPARATUS AND DRIVING METHOD THEREOF

This application claims priority to Korean Patent Application No. 10-2013-0091339, filed on Aug. 1, 2013, and all the benefits accruing therefrom under 35 U.S.C. §119, the content of which in its entirety is herein incorporated by reference.

BACKGROUND

1. Field

The invention described herein relate to a display apparatus and a driving method thereof.

2. Description of the Related Art

As one of display apparatuses, a liquid crystal display apparatus has merits such as a slim design, low power consumption, high resolution, etc., and is widely applied to a notebook computer, a monitor, an advertising display, a television, etc.

The liquid crystal display device has such a disadvantage such that brightness and color are variable according to a direction from which a viewer observes a screen, that is, due to liquid crystal anisotropy. A liquid crystal display device having a wide viewing angle is required to improve a narrow viewing angle.

SUMMARY

Exemplary embodiments of the invention are directed to a display apparatus which includes a display panel including a plurality of pixels connected to a plurality of gate lines and a plurality of data lines, each pixel including a first sub-pixel and a second sub-pixel; a gate driver configured to drive the plurality of gate lines; a data driver configured to drive the plurality of data lines; and a timing controller configured to control the gate driver and the data driver and to output a first data signal and a second data signal for the first sub-pixel and the second sub-pixel in response to an image signal, where when the image signal is a first type of image signal, the first data signal and the second data signal correspond to one of a high gray scale curve and a low gray scale curve alternately every frame, and when the image signal is a second type of image signal, the first data signal corresponds to the high gray scale curve and the second data signal corresponds to the low gray scale curve.

In an exemplary embodiment, the timing controller may determine the image signal as the first type of image signal when an image signal of a previous frame is different from an image signal of a current frame, and determine the image signal as the second type of image signal when the image signal of the previous frame is substantially equal to the image signal of the current frame.

In an exemplary embodiment, the timing controller may include: a first conversion unit configured to convert the image signal into a first dynamic data signal and a second dynamic data signal corresponding to the high gray scale curve and the low gray scale curve; a second conversion unit configured to convert the image signal into a first static data signal and a second static data signal corresponding to the high gray scale curve and the low gray scale curve; an image determination unit configured to compare the image signal of the previous frame and the image signal of the current frame and to output a selection signal corresponding to a result of comparison; and a selection circuit configured to receive the first and second dynamic data signals and the first and second static data signals and to output the first and second data signals in response to the selection signal.

In an exemplary embodiment, the first conversion unit may output the first and second dynamic data signals corresponding to the high gray scale curve during a first frame of two consecutive frames, and output the first and second static data signals corresponding to the high gray scale curve during a second frame of the two consecutive frames.

In an exemplary embodiment, the second conversion unit may output the first static data signal corresponding to the high gray scale curve and the second static data signal corresponding to the low gray scale curve.

In an exemplary embodiment, the first conversion unit may include: a high gray scale conversion unit configured to receive the image signal and to output a high gray scale signal corresponding to the high gray scale curve; a low gray scale conversion unit configured to receive the image signal and to output a low gray scale signal corresponding to the low gray scale curve; and a selector configured to output one of the high gray scale signal and the low gray scale signal as the first dynamic data signal and the second dynamic data signal every frame.

In an exemplary embodiment, the second conversion unit may include a high gray scale conversion unit configured to receive the image signal and to output the first static data signal corresponding to the high gray scale curve; and a low gray scale conversion unit configured to receive the image signal and to output a second static data signal corresponding to the low gray scale curve.

In an exemplary embodiment, the timing controller may compare the image signal of the current frame and the image signal of the previous frame on a pixel-by-pixel basis.

In an exemplary embodiment, the timing controller may include: a double frame conversion unit configured to convert the image signal into a first image signal and a second image signal; a first conversion unit configured to convert the first image signal and the second image signal into a dynamic data signal corresponding to the high gray scale curve and the low gray scale curve alternately every frame; a first selector configured to select one of the first image signal and the dynamic data signal as an intermediate data signal in response to the selection signal; a second conversion unit configured to convert the intermediate data signal into a first static data signal corresponding to the high gray scale curve and a second static data signal corresponding to the low gray scale signal; and a second selector configured to receive the first and second static data signals and the intermediate data signal and to output the first data signal and the second data signal in response to the selection signal.

In an exemplary embodiment, the first conversion unit may include: a high gray scale conversion unit configured to receive the first image signal and to output a high gray scale signal corresponding to the high gray scale curve; a low gray scale conversion unit configured to receive the second image signal and to output a low gray scale signal corresponding to the low gray scale curve; and a third selector configured to output one of the high gray scale signal and the low gray scale signal as the dynamic data signal every frame.

In an exemplary embodiment, the second conversion unit may include: a high gray scale conversion unit configured to receive the intermediate data signal and to output the first static data signal corresponding to the high gray scale curve; and a low gray scale conversion unit configured to receive the intermediate data signal and to output the second static data signal corresponding to the low gray scale curve.

In an exemplary embodiment, the timing controller may include: a double frame conversion unit configured to convert the image signal into a first image signal and a second image signal; a first conversion unit configured to convert the first image signal and the second image signal into a first dynamic data signal and a second dynamic data signal; a second conversion unit configured to convert the first image signal and the second image signal into a first static data signal corresponding to the high gray scale curve and a second static data signal corresponding to the low gray scale signal; and a selector configured to receive the first and second dynamic data signals and the first and second static data signals and to output the first data signal and the second data signal in response to the selection signal.

In an exemplary embodiment, the first conversion unit may include: a high gray scale conversion unit configured to receive the first image signal and to output a high gray scale signal corresponding to the high gray scale curve; a low gray scale conversion unit configured to receive the second image signal and to output a low gray scale signal corresponding to the low gray scale curve; and an output unit configured to output the high gray scale signal and the low gray scale signal as the first dynamic data signal and the second dynamic data signal, where during a first frame of two consecutive frames, the output unit may output the high gray scale signal as the first dynamic data signal and the low gray scale signal as the second dynamic data signal, and during a second frame of the two consecutive frames, the output unit may output the low gray scale signal as the first dynamic data signal and the high gray scale signal as the second dynamic data signal In an exemplary embodiment, the first and second sub-pixels of each pixel may be connected to a same gate line of the plurality of gate lines and connected to two different data lines of the plurality of data lines, respectively.

In an exemplary embodiment, the first sub-pixel comprises a first transistor connected between a first data line of the two different data lines and a first node and including a gate connected to the same gate line; and a liquid crystal capacitor connected between the first node and a common voltage.

In an exemplary embodiment, the second sub-pixel comprises a second transistor connected between a second data line of the two different data lines and a second node and comprising a gate connected to the same gate line; and a liquid crystal capacitor connected between the second node and a common voltage.

Exemplary embodiments of the invention are directed to a driving method of a display apparatus which includes: receiving an image signal; converting the image signal into a first image signal and a second image signal; determining a type of the first image signal; outputting a first data signal and a second data signal corresponding to one of a high gray scale curve and a low gray scale curve, alternately every frame, when the first image signal is a first type of image signal; and outputting a first data signal corresponding to the high gray scale curve and a second data signal corresponding to the low gray scale curve when the first image signal is a second type of image signal.

In an exemplary embodiment, the determining the type of the first image signal may include determining the first image signal as the first type of image signal when the first image signal of a current frame is different from the first image signal of a previous frame; and determining the first image signal as the second type of image signal when the first image signal of the current frame is substantially equal to the first image signal of the previous frame.

In an exemplary embodiment, a frequency of each of the first and second image signals may be about twice a frequency of the image signal.

In an exemplary embodiment, the method may further include providing the first data signal to a first sub-pixel of a pixel of the display apparatus and providing the second data signal to a second sub-pixel of the pixel of the display apparatus.

BRIEF DESCRIPTION OF THE FIGURES

The above and other features of the invention will become more apparent by describing in further detail exemplary embodiments thereof with reference to the accompanying drawings, in which.

DETAILED DESCRIPTION

Figure 1:
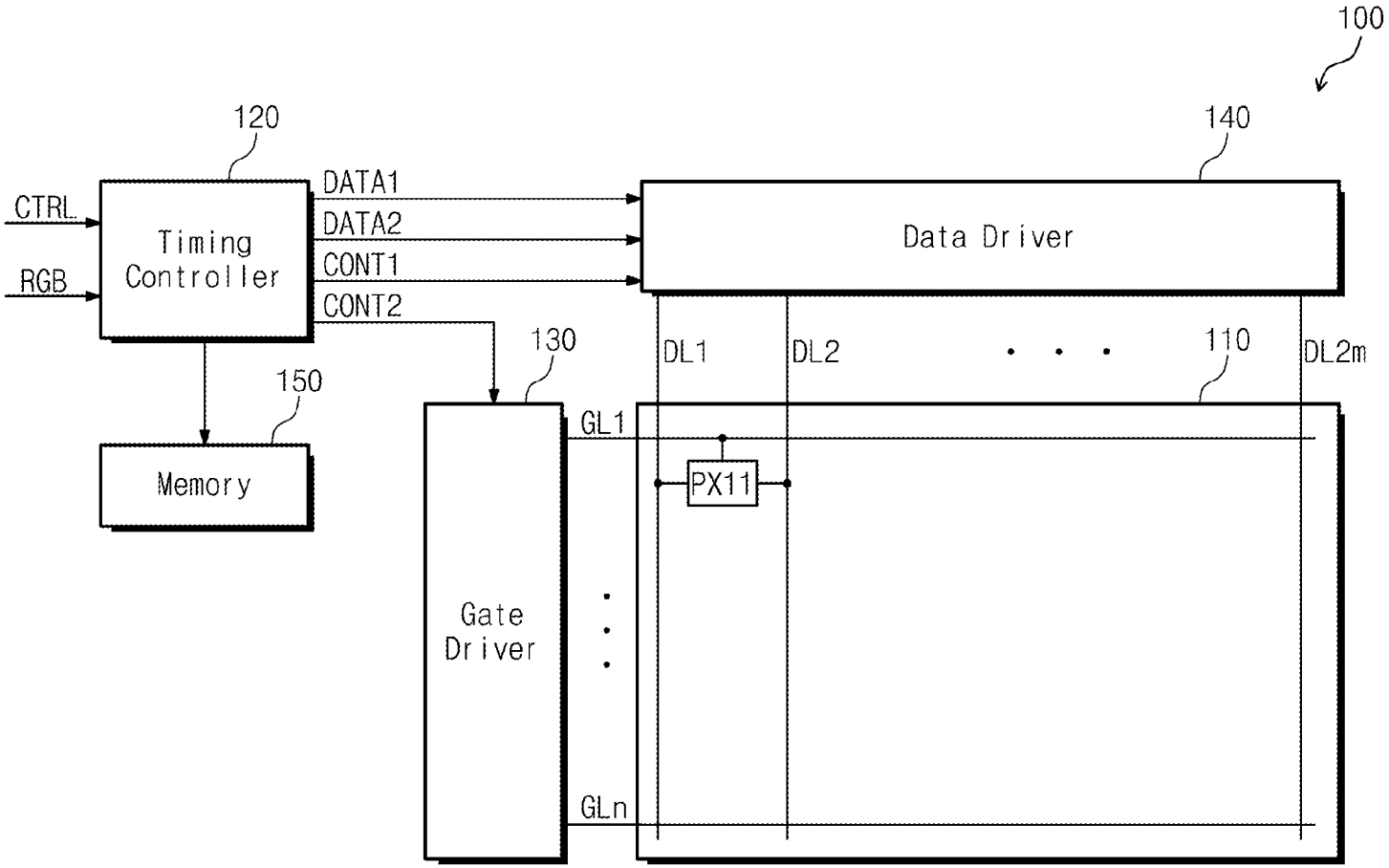
FIG. 1 is a block diagram schematically illustrating an exemplary embodiment of a display apparatus, according to the invention.

The invention now will be described more fully hereinafter with reference to the accompanying drawings, in which various embodiments are shown. The invention may, however, be embodied in various different forms, and should not be construed as being limited to the embodiments set forth herein. Rather, these embodiments are provided so that this disclosure will be thorough and complete, and will fully convey the scope of the invention to those skilled in the art. Like reference numerals refer to like elements throughout.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings herein.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Also, the term "exemplary" is intended to refer to an example or illustration.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

It will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Hereinafter, exemplary embodiments of the invention will be described in detail with reference to the accompanying drawings.

FIG. 1 is a block diagram schematically illustrating an exemplary embodiment of a display apparatus, according to the invention. Hereinafter, an exemplary embodiment where the display apparatus is a liquid crystal display apparatus will be illustrated and described. However, the invention is not limited thereto, and the invention is applicable to various types of display apparatus.

Referring to FIG. 1, an exemplary embodiment of a display apparatus includes a display panel 110, a timing controller 120, a gate driver 130, a data driver 140 and a memory 150.

The display panel 110 includes a plurality of data lines, e.g., first to 2m-th data lines DL1 to DL2*m*, a plurality of gate lines, e.g., first to n-th gate lines GL1 to GLn, arranged to cross the data lines DL1 to DL2*m*, and a plurality of pixels connected to the data lines DL1 to DL2*m* and the gate lines GL1 to GLn. In an exemplary embodiment, as shown in FIG. 1, a pixel PX11 may be connected to corresponding data lines, e.g., first and second data lines DL1 and DL2, and a corresponding gate line, e.g., a first gate line GL1, is illustrated. In such an embodiment, the pixels may be arranged substantially in a matrix form, e.g., n×m matrix. In exemplary embodiments, the display panel 110 is implemented by a super-patterned vertical alignment ("S-PVA") mode. In the S-PVA mode display panel 110, a pixel includes two subpixels and different data signals are provided to the two subpixels. A configuration of the pixel included in the display panel 110 is described later in greater detail.

The timing controller 120 receives an image signal RGB and control signals CTRL (e.g., a horizontal synchronization signal, a vertical synchronization signal, a main clock signal, a data enable signal, etc.) for controlling a display of the image signal RGB from an external device.

The timing controller 120 provides first data signal DATA1, second data signal DATA2 and a first control signal CONT1 to the data driver 140, and a second control signal CONT2 to the gate driver 130. In such an embodiment, the timing controller generates the first data signal DATA1 and the second data signal DATA2 by processing the image signal RGB in response to the control signals CTRL based on an operation condition of the display panel. The first control signal CONT1 may include a clock signal, a polarity inversion signal and a line latch signal, for example. The second control signal CONT2 may include a vertical synchronization start signal, an output enable signal and a gate pulse signal, for example. Configuration and operation of the timing controller 120 will be described later in greater detail.

The gate driver 130 drives the gate lines GL1 to GLn in response to the second control signal CONT2 from the timing controller 120. In an exemplary embodiment, the gate driver 130 may be implemented by an integrated circuit ("IC") chip and may be mounted on the display panel 110 in a chip-on-glass ("COG") structure or mounted on a film (not shown) attached on the display panel 110 in a chip-on-film ("COF") structure. In an alternative exemplary embodiment, the gate driver 130 may be implemented in a circuit including amorphous silicon gate ("ASG") using an amorphous silicon thin film transistor ("a-Si TFT"), oxide semiconductor, crystalline semiconductor or poly crystalline semiconductor, for example.

The data driver 140 drives the data lines DL1 to DL2*m* in response to the first data signal DATA1, the second data signal DATA2 and the first control signal CONT1 from the timing controller 120. In exemplary embodiments, the number of data lines arranged at the display panel 110 is twice the number of pixels connected to a gate line, that is, when the number of pixels connected to the gate line is m, the number of data lines arranged at the display panel 110 is 2×m. Here, m is a natural number.

The memory 150 stores data for an operation of the timing controller 120. In one exemplary embodiment, for example, the memory 150 stores an image signal RGB input from the external device or stores a lookup table.

Figure 2:
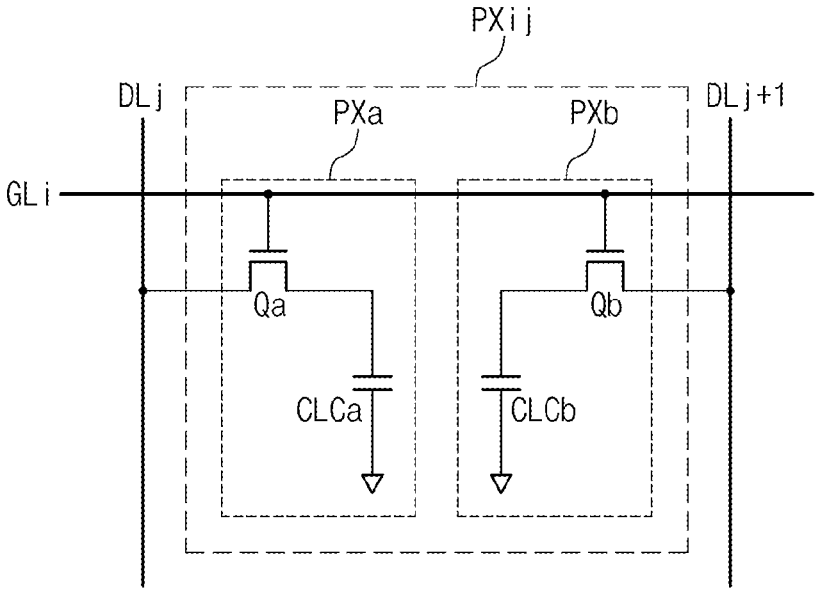
FIG. 2 is a circuit diagram schematically illustrating an exemplary embodiment of a pixel shown in FIG. 1, according to the invention.

FIG. 2 is a circuit diagram schematically illustrating an exemplary embodiment of a pixel shown in FIG. 1, according to the invention.

Referring to FIG. 2, a pixel PXij is connected to a corresponding gate line, e.g., an i-th gate line GLi, a corresponding first data line, e.g., a j-th data line DLj, and a corresponding second data line, e.g., a (j+1)-th data line DLj+1. The pixel PXij includes a first sub-pixel PXa and a second sub-pixel PXb.

The first sub-pixel PXa includes a switching transistor Qa and a liquid crystal capacitor CLCa. The switching transistor Qa of the first sub-pixel PXa is connected between the j-th data line DLj and one end of the liquid crystal capacitor CLCa of the first sub-pixel PXa and has a gate terminal connected to the i-th gate line GLi. The other end of the liquid crystal capacitor CLCa of the first sub-pixel PXa is connected to a common voltage.

The second sub-pixel PXb includes a switching transistor Qb and a liquid crystal capacitor CLCb. The switching transistor Qb of the second sub-pixel PXb is connected between the (j+1)-th data line DLj+1 and one end of the liquid crystal capacitor CLCb of the second sub-pixel PXb and has a gate terminal connected to the i-th gate line GLi. The other end of the liquid crystal capacitor CLCb of the second sub-pixel PXb is connected to the common voltage.

Figure 3:
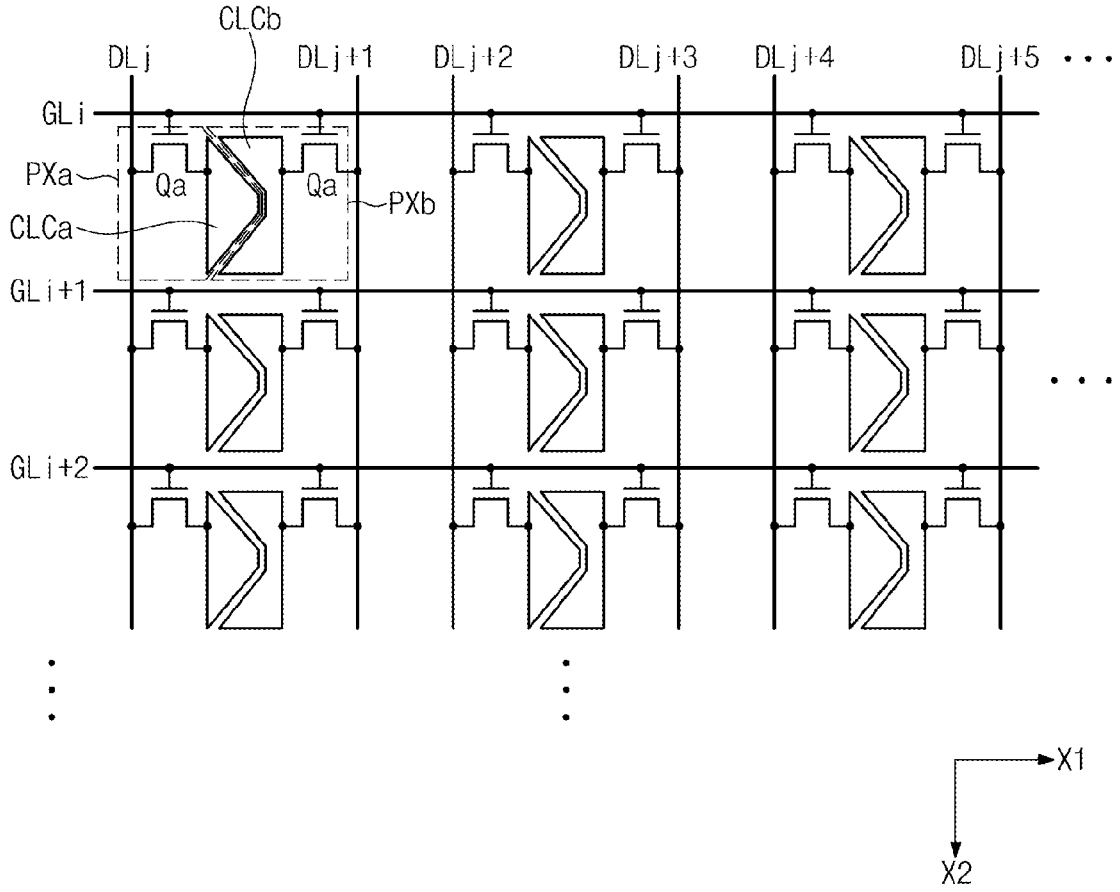
FIG. 3 is a diagram schematically illustrating shapes of an exemplary embodiment of liquid crystal capacitors of first and second sub-pixels shown in FIG. 2, according to the invention.

FIG. 3 is a diagram schematically illustrating shapes of an exemplary embodiment of liquid crystal capacitors of first and second sub-pixels shown in FIG. 2, according to the invention.

Referring to FIG. 3, a liquid crystal capacitor CLCa of a first sub-pixel PXa and a liquid crystal capacitor CLCb of a second sub-pixel PXb are arranged to be adjacent to each other in a pixel connected to an i-th gate line GLi and j-th and (j+1)-th data lines DLj and DLj+1. The liquid crystal capacitor CLCa of the first sub-pixel PXa and the liquid crystal capacitor CLCb of the second sub-pixel PXb are divided based on a portion forming an angle of about 45° with respect to an i-th gate line GLi and a portion substantially perpendicular to the i-th gate line GLi. Here, a length of the portion forming an angle of about 45° with respect to the i-th gate line GLi is greater than a length of the portion substantially perpendicular to the gate line GLi. In such an embodiment, the liquid crystal capacitor CLCa of the first sub-pixel PXa and the liquid crystal capacitor CLCb of the second sub-pixel PXb has a substantially symmetric shape with reference to a line substantially parallel to the i-th data line GLi, which divides a pixel area defined by the i-th gate line GLi and the j-th and (j+1)-th data lines DLj and DLj+1 into an upper portion and a lower portion.

Figure 4:
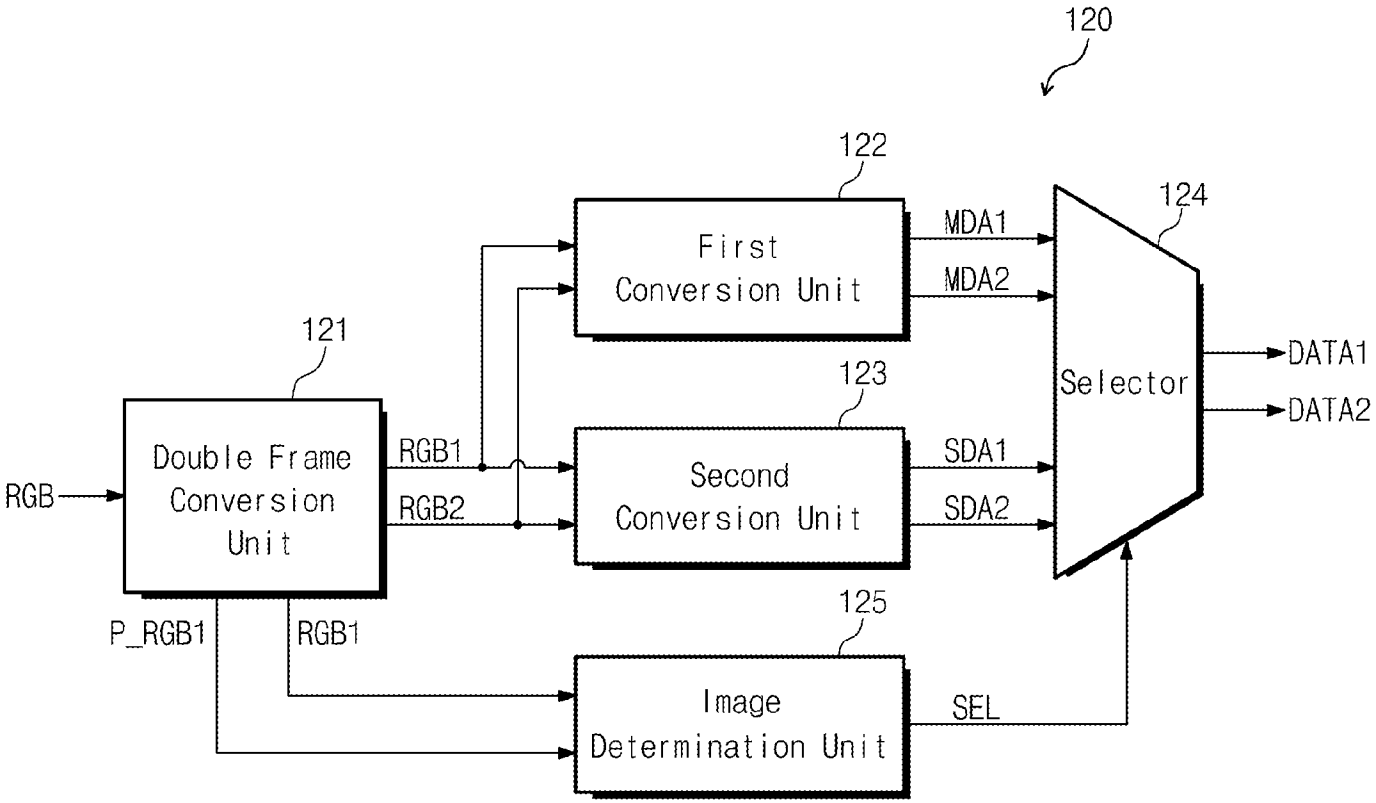
FIG. 4 is a block diagram schematically illustrating an exemplary embodiment of a timing controller shown in FIG. 1, according to the invention.

FIG. 4 is a block diagram schematically illustrating an exemplary embodiment of a timing controller shown in FIG. 1, according to the invention.

Referring to FIG. 4, a timing controller 120 includes a double frame conversion unit 121, a first conversion unit 122, a second conversion unit 123, a selector 124 and an image determination unit 125.

The double frame conversion unit 121 converts an image signal RGB input from an external device into a first image signal RGB1 and a second image signal RGB2. The first image signal RGB1 and the second image signal RGB2 are substantially the same as the image signal RGB, and frequencies of the first image signal RGB1 and the second image signal RGB2 are about twice the frequency of the image signal RGB. In one exemplary embodiment, for example, a frequency of the image signal RGB is about 60 hertz (Hz), and each of the first image signal RGB1 and the second image signal RGB2 has a frequency of about 120 Hz.

The first conversion unit 122 receives the first and second image signals RGB1 and RGB2 from the double frame conversion unit 121 and outputs a first dynamic data signal MDA1 and a second dynamic data signal MDA2, which correspond to a low gray scale curve and a high gray scale curve, respectively.

The second conversion unit 122 receives the first and second image signals RGB1 and RGB2 from the double frame conversion unit 121 and outputs a first static data signal SDA1 and a second static data signal SDA2, which correspond to the low gray scale curve and the high gray scale curve, respectively.

In an exemplary embodiment, the first dynamic data signal MDA1, the second dynamic data signal MDA2, the first static data signal SDA1 and the second static data signal SDA2 may be stored in the memory 150 shown in FIG. 1 in the form of a lookup table. In such an embodiment, the first and second conversion units 122 and 123 outputs the first dynamic data signal MDA1, the second dynamic data signal MDA2, the first static data signal SDA1 and the second static data signal SDA2 based on the first and second image signals RGB1 and RGB2 referring to the lookup table in the memory 150. In an alternative exemplary embodiment, each of the first and second conversion units 122 and 123 may include a lookup table disposed therein.

The image determination unit 125 compares a first image signal RGB1 of a current frame with a first image signal P_RGB1 of a previous frame and outputs a selection signal SEL based on the result of comparison. In one exemplary embodiment, for example, when the first image signal RGB1 of the current frame is different from the first image signal P_RGB1 of the previous frame, the image determination unit 125 determines the first image signal RGB1 of the current frame as a moving picture and outputs the selection signal SEL having a first level. When the first image signal RGB1 of the current frame is substantially equal to the first image signal P_RGB1 of the previous frame, the image determination unit 125 determines the first image signal RGB1 of the current frame as a still image and outputs the selection signal SEL having a second level. Here, a frame means periods of the first and second image signals RGB1 and RGB2, and frequencies of the first and second image signals RGB1 and RGB2 are about twice the frequency of the image signal RGB.

The selector 124 receives the first and second dynamic data signals MDA1 and MDA2 from the first conversion unit 122 and the first and second static data signals SDA1 and SDA2 from the second conversion unit 123 and outputs first data DATA1 and second data DATA2 in response to the selection signal from the image determination unit 125.

In one exemplary embodiment, for example, when the selection signal SEL has the first level, the selector 124 selects and outputs the first and second dynamic data signals MDA1 and MDA2 from the first conversion unit 122 as the first data DATA1 and second data DATA2. When the selection signal SEL has the second level, the selector 124 selects and outputs the first and second static data signals SDA1 and SDA2 from the second conversion unit 123 as the first data DATA1 and second data DATA2.

Figure 5:
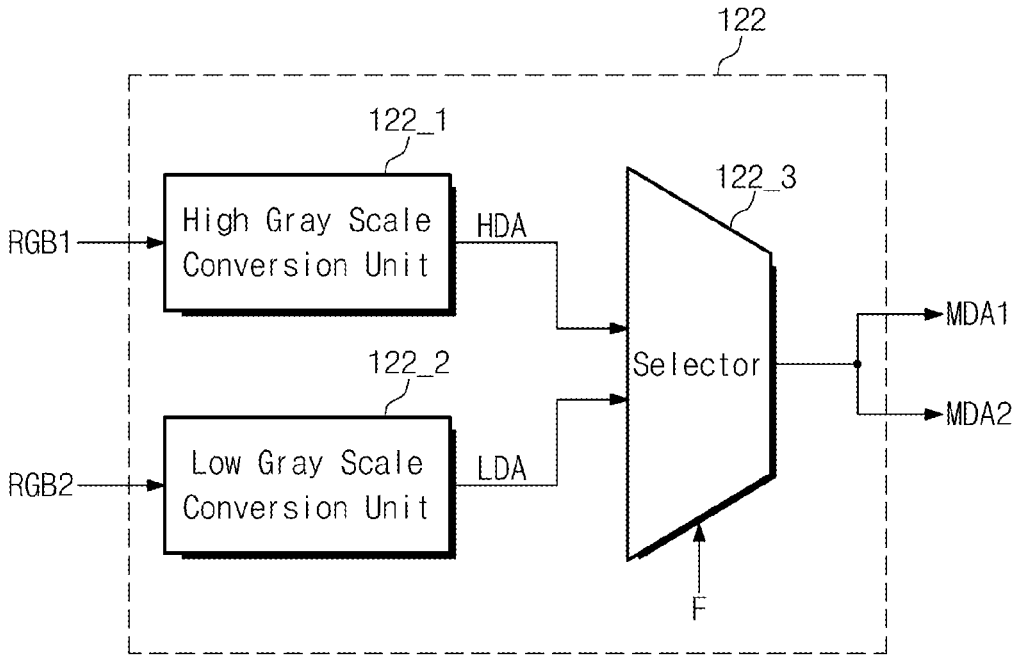
FIG. 5 is a block diagram schematically illustrating an exemplary embodiment of a first conversion unit shown in FIG. 4, according to the invention.

FIG. 5 is a block diagram schematically illustrating an exemplary embodiment of a first conversion unit shown in FIG. 4, according to the invention.

Referring to FIG. 5, a first conversion unit 122 includes a high gray scale conversion unit 122_1, a low gray scale conversion unit 122_2 and a selector 122_3. The high gray scale conversion unit 122_1 converts the first image signal RGB1 into a high gray scale signal HDA corresponding to the high gray scale curve. The low gray scale conversion unit 122_2 converts the second image signal RGB2 into a low gray scale signal LDA corresponding to the low gray scale curve. The selector 122_3 selects one of the high gray scale signal HDA from the high gray scale conversion unit 122_1 and the low gray scale signal LDA from the low gray scale conversion unit 122_2 as first and second dynamic data signals MDA1 and MDA2 in response to a frame signal F. The selector 122_3 selects one of the high gray scale signal HDA and the low gray scale signal LDA every frame in response to the frame signal F. In one exemplary embodiment, for example, during an odd-numbered frame, the selector 122_3 outputs the high gray scale signal HDA from the high gray scale conversion unit 122_1 as the first and second dynamic data signals MDA1 and MDA2. In such an embodiment, during an even-numbered frame, the selector 122_3 outputs the low gray scale signal LDA from the low gray scale conversion unit 122_2 as the first and second dynamic data signals MDA1 and MDA2. In exemplary embodiments, the first and second dynamic data signals MDA1 and MDA2 output from the first conversion unit 122 are substantially the same as each other.

Figure 6:
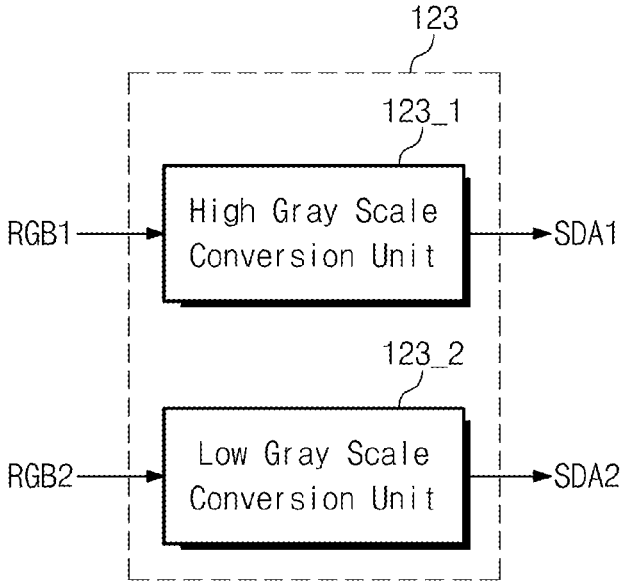
FIG. 6 is a block diagram schematically illustrating an exemplary embodiment of a second conversion unit shown in FIG. 4, according to the invention.

FIG. 6 is a block diagram schematically illustrating an exemplary embodiment of a second conversion unit shown in FIG. 4, according to the invention.

Referring to FIG. 6, a second conversion unit 123 includes a high gray scale conversion unit 123_1 and a low gray scale conversion unit 123_2. The high gray scale conversion unit 123_1 converts the first image signal RGB1 into the first static data signal SDA1 corresponding to the high gray scale curve. The low gray scale conversion unit 123_2 converts the second image signal RGB2 into the second static data signal SDA2 corresponding to the low gray scale curve.

Figure 7:
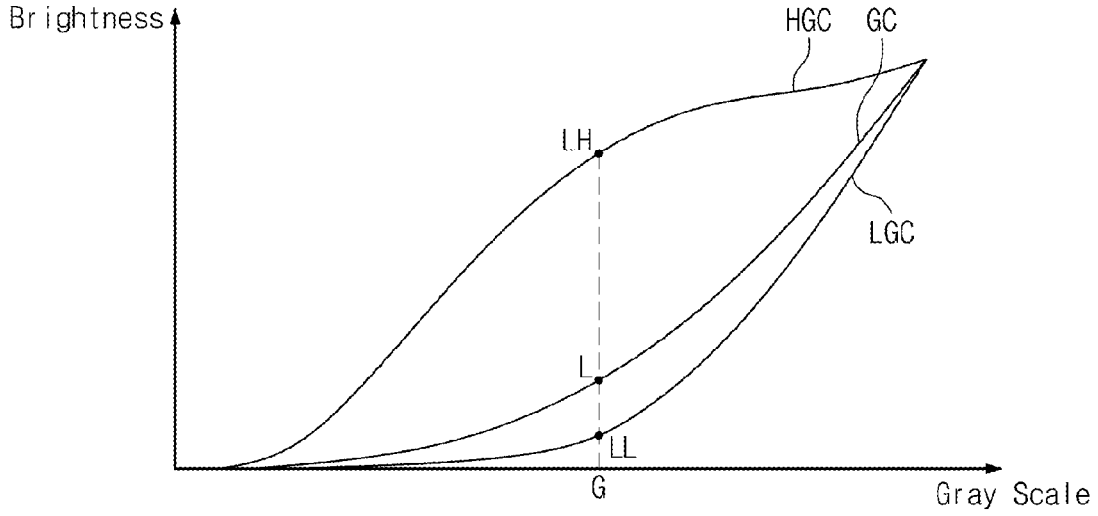
FIG. 7 is a graph showing a high gray scale curve and a low gray scale curve.

FIG. 7 is a graph showing a high gray scale curve and a low gray scale curve.

Referring to FIG. 7, a high gray scale curve HGC and a low gray scale curve LGC show brightness versus gray scale. In one exemplary embodiment, for example, when a gray scale of an image signal RGB corresponding to a gray scale curve GC, first and second data signals DATA1 and DATA2 corresponding to the high gray scale curve HGC are provided to first and second sub-pixels PXa and PXb, respectively, during a first frame F1. In such an embodiment, first and second data signals DATA1 and DATA2 corresponding to the low gray scale curve LGC are provided to the first and second sub-pixels PXa and PXb, respectively, during a second frame F2. Thus, a viewer recognizes brightness L corresponding to the gray scale curve GC when high gray scale brightness LH displayed through the first and second sub-pixels PXa and PXb during the first frame F1 and low gray scale brightness LL displayed through the first and second sub-pixels PXa and PXb during the second frame F2 are combined.

The high gray scale curve HGC corresponds to brightness providing high visibility at a side of a display panel 110, and the low gray scale curve LGC corresponds to brightness providing high visibility at a front of the display panel 110. Thus, a variation in visibility according to a location of a viewer is reduced by providing the first and second sub-pixels PXa and PXb with the first and second data signals DATA1 and DATA2 corresponding to the high gray scale curve HGC and the low gray scale curve LGC, respectively, alternately every frame. Accordingly, in such an embodiment, the visibility of a display device 100 is substantially improved.

When a technique of changing brightness every frame is applied to a still image or a particular image having a constant pattern, a flicker may be recognized.

Figure 8:
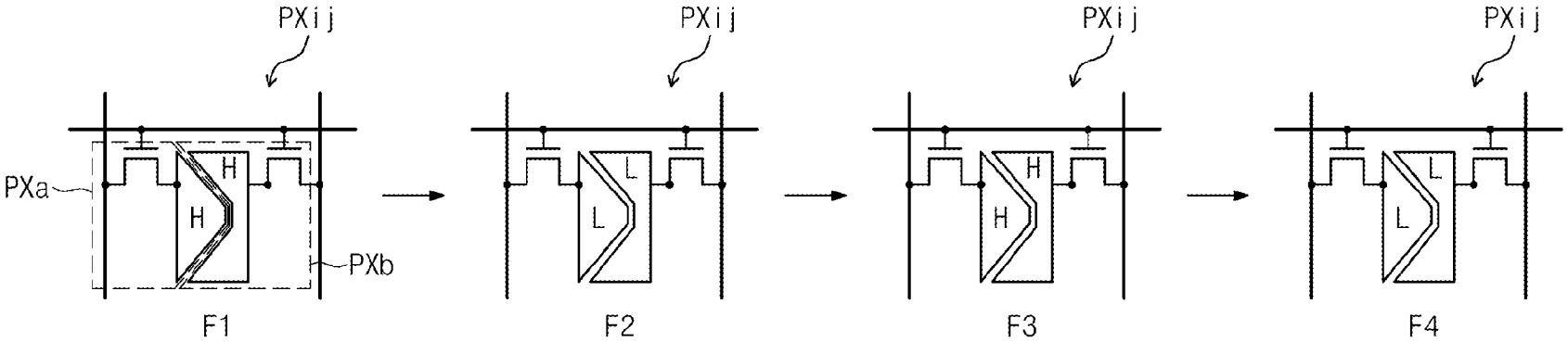
FIG. 8 is a diagram showing a first data signal and a second data signal provided to a predetermined pixel in an exemplary embodiment of a display panel when an image signal is a moving picture, according to the invention.

FIG. 8 is a diagram showing a first data signal and a second data signal provided to a predetermined pixel in an exemplary embodiment of a display panel when an image signal is a moving picture, according to the invention.

Referring to FIGS. 4 and 8, an image determination unit 125 compares a first image signal RGB1 of a current frame with a first image signal P_RGB1 of a previous frame and output a selection signal SEL based on the result of comparison. In one exemplary embodiment, for example, when the first image signal RGB1 of the current frame is different from the first image signal P_RGB1 of the previous frame, the image determination unit 125 determines the first image signal RGB1 of the current frame as a moving picture and outputs the selection signal SEL having a first level. In such an embodiment, a selector 124 outputs first and second dynamic data signals MDA1 and MDA2 from a first conversion unit 122 as first data DATA1 and second data DATA2 in response to the selection signal SEL having the first level.

In odd-numbered frames, e.g., first and third frames F1 and F3, the first conversion unit 122 outputs the first image signal RGB1 as the first and second dynamic data signals MDA1 and MDA2 corresponding to a high gray scale curve, e.g., the high gray scale curve HGC shown in FIG. 7. In even-numbered frames, e.g., second and fourth frames F2 and F4, the first conversion unit 122 outputs a second image signal RGB2 as the first and second dynamic data signals MDA1 and MDA2 corresponding to a low gray scale curve, e.g., the low gray scale curve LGC shown in FIG. 7.

In such an embodiment, the first sub-pixel PXa and the second sub-pixel PXb in a pixel PXij alternately display an image having brightness corresponding to the high gray scale curve HGC and the low gray scale curve LGC every frame.

Figure 9:
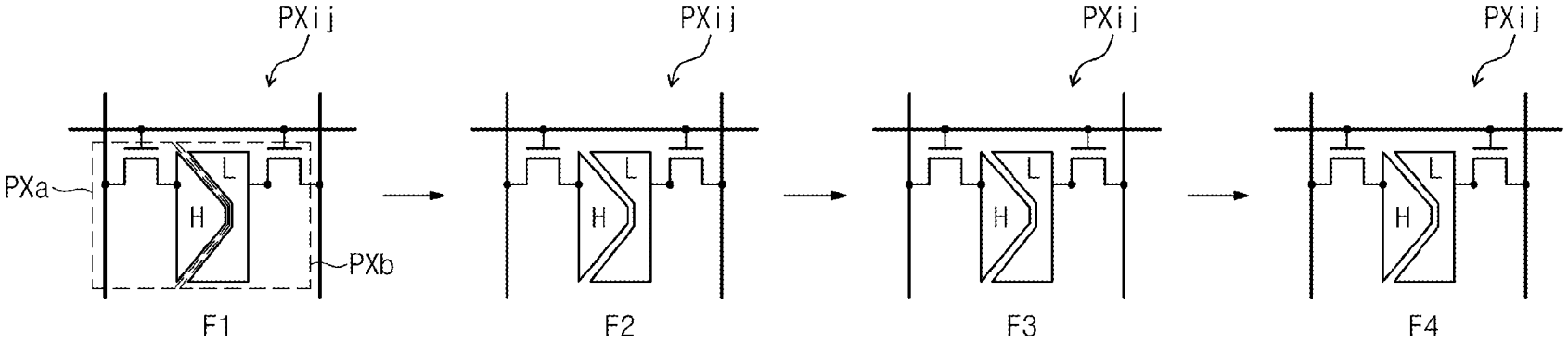
FIG. 9 is a diagram showing a first data signal and a second data signal provided to a predetermined pixel in an exemplary embodiment of a display panel when an image signal is a still image, according to the invention.

FIG. 9 is a diagram showing a first data signal and a second data signal provided to a predetermined pixel in an exemplary embodiment of a display panel when an image signal is a still image, according to the invention.

Referring to FIGS. 4 and 9, the image determination unit 125 compares a first image signal RGB1 of a current frame with a first image signal P_RGB1 of a previous frame and output a selection signal SEL based on the result of comparison. In one exemplary embodiment, for example, when the first image signal RGB1 of the current frame is substantially equal to the first image signal P_RGB1 of the previous frame, the image determination unit 125 determines the first image signal RGB1 of the current frame as a still image and outputs the selection signal SEL having a second level. In such an embodiment, the selector 124 outputs first and second static data signals SDA1 and SDA2 from a second conversion unit 123 as first data DATA1 and second data DATA2 in response to the selection signal SEL having the second level.

The second conversion unit 123 converts the first image signal RGB1 into a first static data signal SDA1 corresponding to a high gray scale curve, e.g., the high gray scale curve HGC shown in FIG. 7 and the second image signal RGB2 into a second static data signal SDA2 corresponding to a low gray scale curve, e.g., the low gray scale curve LGC shown in FIG. 7.

Thus, a first sub-pixel PXa of a pixel PXij displays an image of brightness corresponding to the high gray scale curve HGC, and a second sub-pixel PXb of the pixel PXij displays an image of brightness corresponding to the low gray scale curve LGC. When a still image is received, the first sub-pixel PXa of the pixel PXij displays an image of brightness corresponding to the high gray scale curve HGC and the second sub-pixel PXb of the pixel PXij displays an image of brightness corresponding to the low gray scale curve LGC. Thus, visibility of a display panel 110 is substantially improved and an occurrence of a flicker is effectively prevented.

Figure 10:
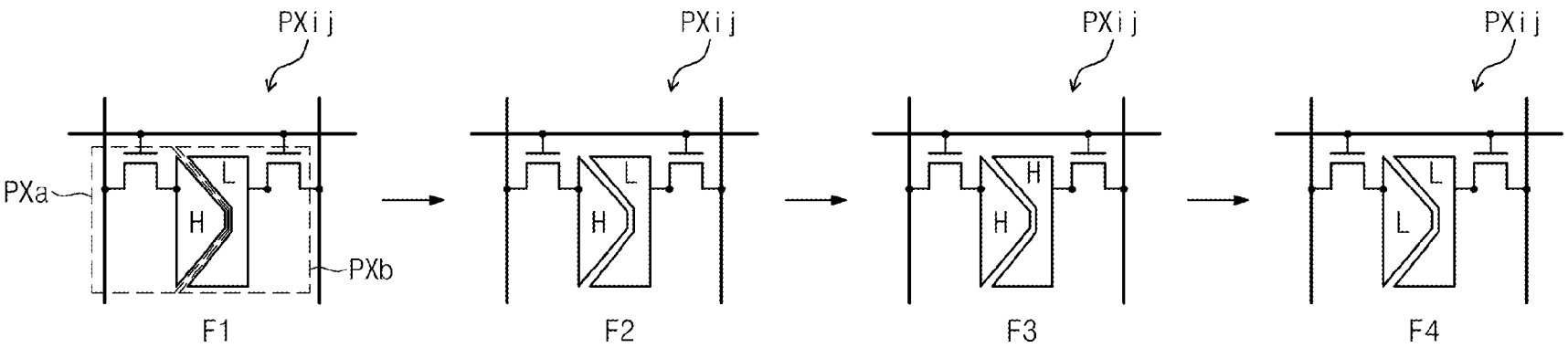
FIG. 10 is a diagram showing a first data signal and a second data signal provided to a predetermined pixel in an exemplary embodiment of a display panel when an image signal provided from an external device is changed from a still image to a moving picture, according to the invention.

FIG. 10 is a diagram showing a first data signal and a second data signal provided to a predetermined pixel in an exemplary embodiment of a display panel when an image signal provided from an external device is changed from a still image to a moving picture, according to the invention.

Referring to FIGS. 4 and 10, when a first image signal RGB1 is determined as a still image in a first frame F1 and a second frame F2, a first sub-pixel PXa of a pixel PXij displays an image of brightness corresponding to a high gray scale curve HGC, and a second sub-pixel PXb of the pixel PXij displays an image of brightness corresponding to a low gray scale curve LGC. In such an embodiment, when the first image signal RGB1 is determined as a moving picture in a third frame F3, the first and second sub-pixels PXa and PXb of the pixel PXij display an image of brightness corresponding to the high gray scale curve HGC. In such an embodiment, when the first image signal RGB1 is determined as a moving picture in a fourth frame F4, the first and second sub-pixels PXa and PXb of the pixel PXij display an image of brightness corresponding to the low gray scale curve LGC.

In an exemplary embodiment, a timing controller 120 compares a first image signal RGB1 of a current frame with a first image signal P_RGB1 of a previous frame on a pixel-by-pixel basis, and outputs a first data signal DATA1 and a second data signal DATA2 based on the result of comparison such that an optimal image is displayed every pixel.

Figure 11:
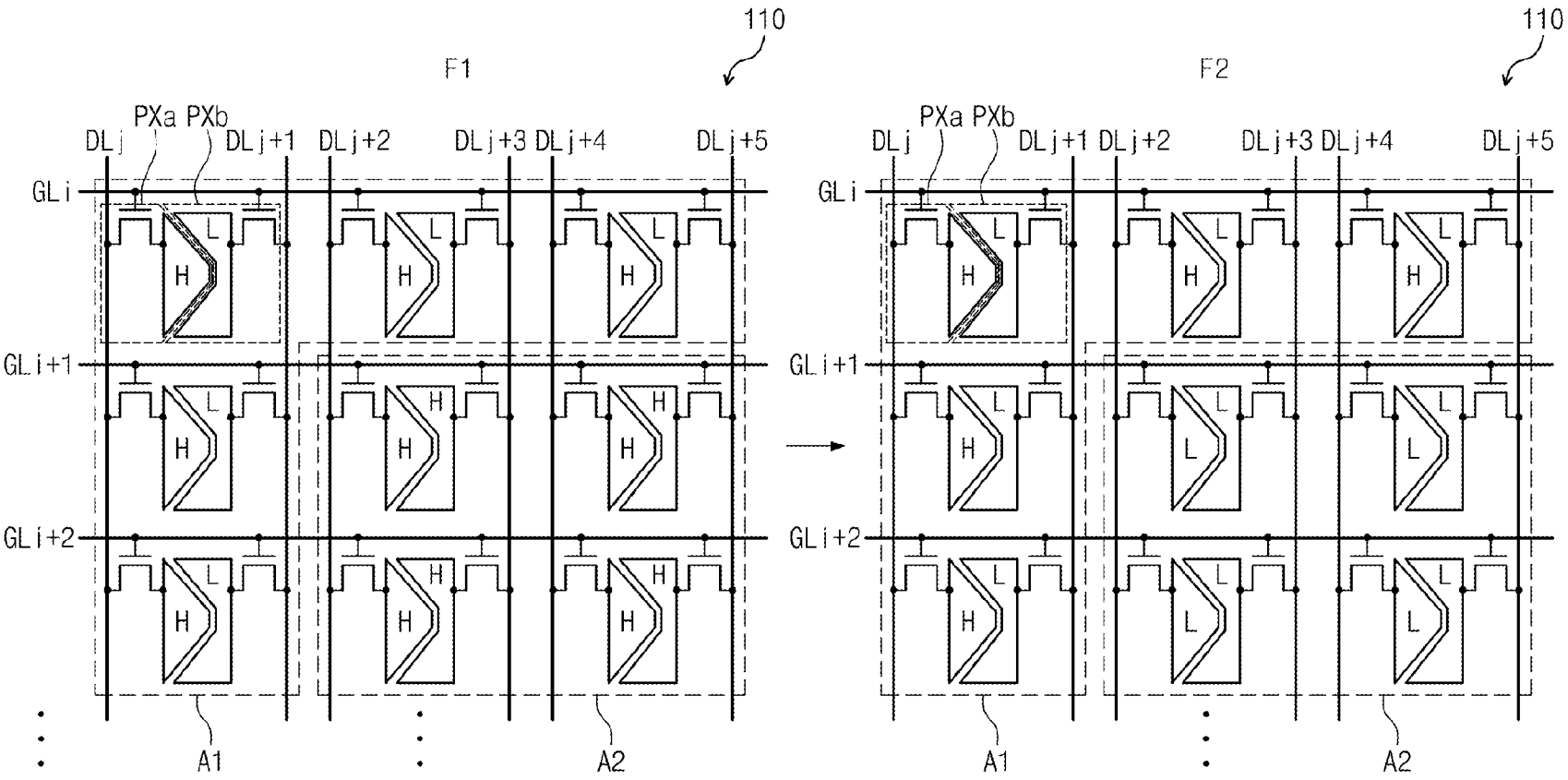
FIG. 11 is a diagram showing a first data signal and a second data signal provided to a predetermined pixel in an exemplary embodiment of a display panel based on an image signal provided from an external device.

FIG. 11 is a diagram showing a first data signal and a second data signal provided to a predetermined pixel in an exemplary embodiment of a display panel based on an image signal provided from an external device.

Referring to FIGS. 4 and 11, in an exemplary embodiment, when an image signal provided to pixels in a first area A1 of a display panel 110 during a first frame F1 is a still image, a first data signal DATA1 provided to the pixels in the first area A1 is a signal corresponding to the high gray scale curve HGC and a second data signal DATA2 is a signal corresponding to the low gray scale curve LGC. In such an embodiment, when an image signal provided to pixels in a second area A2 of the display panel 110 during a first frame F1 is a moving picture, the first data signal DATA1 and the second data signal DATA2 provided to the pixels in the second area A2 are a signal corresponding to the high gray scale curve HGC.

When an image signal provided to pixels in the first area A1 of the display panel 110 during a second frame F2 following the first frame F1 is determined as a still image, the first data signal DATA1 provided to the pixels in the first area A1 is a signal corresponding to the high gray scale curve HGC and the second data signal DATA2 is the signal corresponding to a low gray scale curve LGC. When an image signal provided to pixels in a second area A2 of the display panel 110 during a first frame F1 is a moving picture, the first data signal DATA1 and the second data signal DATA2 provided to the pixels in the second area A2 are a signal corresponding to the low gray scale curve LGC.

As described above, a first data signal DATA1 provided to first and second sub-pixels in the first area A1 where a still image is displayed is a signal corresponding to a high gray scale curve HGC and a second data signal is a signal corresponding to a low gray scale curve LGC. Since the first and second data signals DATA1 and DATA2 provided to first and second sub-pixels in the first area A1 are not changed during displaying of a still image, an occurrence of a flicker is effectively prevented.

The first and second data signals DATA1 and DATA2 provided to first and second sub-pixels in the second area A2 where a moving picture is displayed are changed from a signal corresponding to the high gray scale curve HGC to a signal corresponding to the low gray scale curve LGC.

In the second area A2 where the moving picture is displayed, a variation in visibility according to a location of a viewer is substantially reduced by providing first and second sub-pixels with first and second data signals DATA1 and DATA2 corresponding to the high gray scale curve HGC and the low gray scale curve LGC, alternately every frame. Accordingly, the visibility of a display device 100 is substantially improved.

Figure 12:
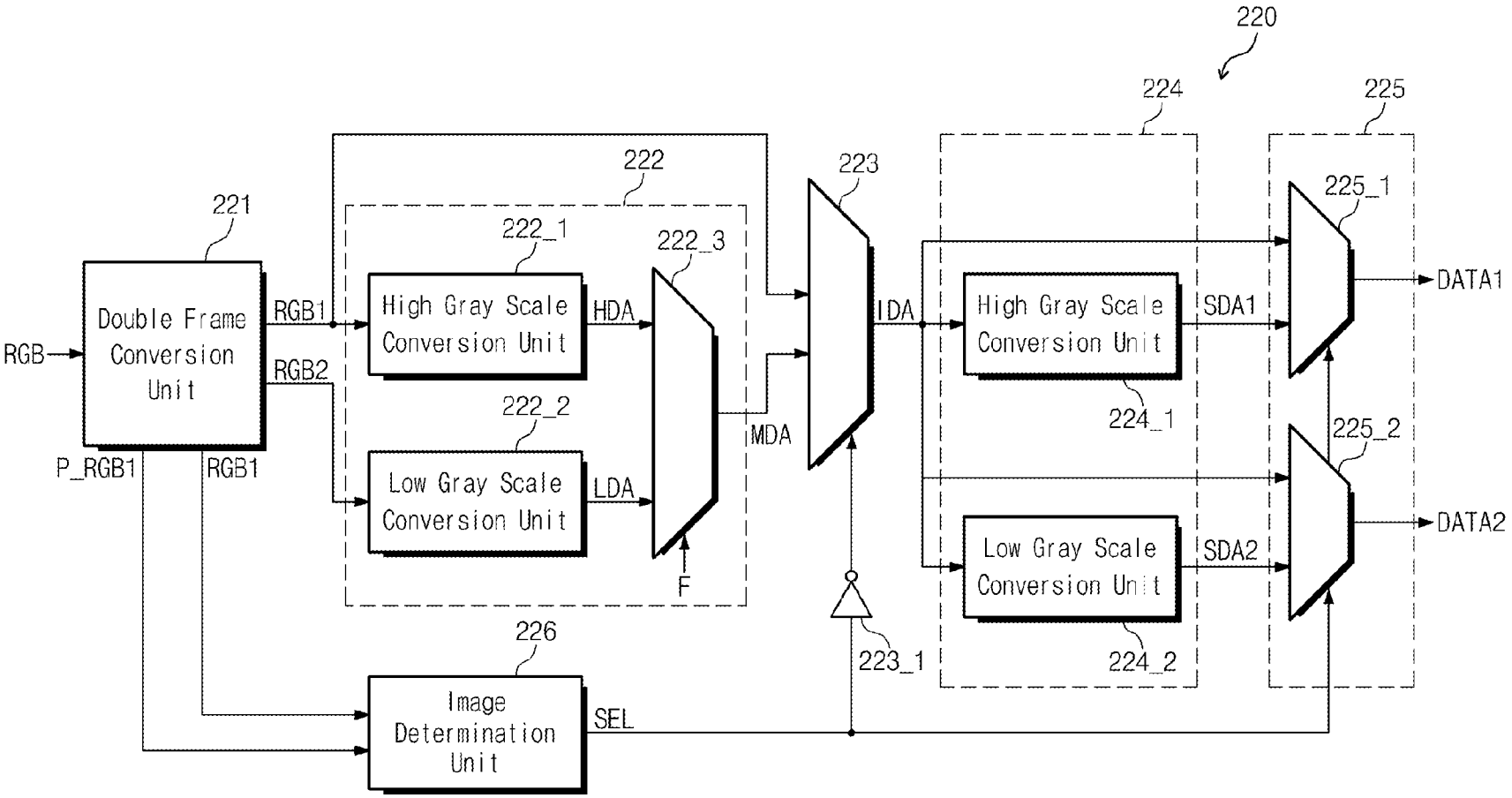
FIG. 12 is a block diagram schematically illustrating an alternative exemplary embodiment of a timing controller shown in FIG. 1, according to the invention.

FIG. 12 is a block diagram schematically illustrating an alternative exemplary embodiment of a timing controller shown in FIG. 1, according to the invention.

Referring to FIG. 12, a timing controller 220 includes a double frame conversion unit 221, a first conversion unit 222, a first selector 223, a second conversion unit 224, a second selector 225 and an image determination unit 226.

The double frame conversion unit 221 converts an image signal RGB input from an external device into a first image signal RGB1 and a second image signal RGB2. The first image signal RGB1 and the second image signal RGB2 are substantially the same as the image signal RGB, and frequencies of the first image signal RGB1 and the second image signal RGB2 are about twice that the frequency of the image signal RGB. In one exemplary embodiment, for example, a frequency of the image signal RGB is about 60 Hz, and each of the first image signal RGB1 and the second image signal RGB2 has a frequency of about 120 Hz.

The first conversion unit 222 receives the first and second image signals RGB1 and RGB2 from the double frame conversion unit 221 and outputs a dynamic data signal MDA. The first conversion unit 222 includes a high gray scale conversion unit 222_1 and a low gray scale conversion unit 222_2. The high gray scale conversion unit 222_1 of the first conversion unit 222 converts the first image signal RGB1 into a high gray scale signal HDA corresponding to a high gray scale curve, e.g., the high gray scale curve HGC shown in FIG. 7. The low gray scale conversion unit 222_2 of the first conversion unit 222 converts the second image signal RGB2 into a low gray scale signal LDA corresponding to a low gray scale curve, e.g., the low gray scale curve LGC shown in FIG. 7. The selector 223 outputs one of the high gray scale signal HDA and the low gray scale signal LDA as the dynamic data signal MDA in response to a frame signal F. Thus, the first conversion unit 222 outputs one of the high gray scale signal HDA and the low gray scale signal LDA alternately every frame, as the dynamic data signal MDA.

The image determination unit 226 compares a first image signal RGB1 of a current frame with a first image signal P_RGB1 of a previous frame and outputs a selection signal SEL based on the result of comparison. In one exemplary embodiment, for example, when the first image signal RGB1 of the current frame is different from the first image signal P_RGB1 of the previous frame, the image determination unit 226 determines the first image signal RGB1 of the current frame as a moving picture and outputs the selection signal SEL having a first level. When the first image signal RGB1 of the current frame is substantially equal to the first image signal P_RGB1 of the previous frame, the image determination unit 226 determines the first image signal RGB1 of the current frame as a still image and outputs the selection signal SEL having a second level.

The first selector 223 outputs one of the first image signal RGB1 and the dynamic data signal MDA as an intermediate data signal IDA in response to a selection signal SEL, which is inverted through an inverter 223_1. In such an embodiment, when the first image signal RGB1 is determined as a still image, the first selector 223 outputs the first image signal RGB1 as the intermediate data signal IDA. When the first image signal RGB1 is determined as a moving picture, the first selector 223 outputs the dynamic data signal MDA as the intermediate data signal IDA.

The second conversion unit 224 includes a high gray scale conversion unit 224_1 and a low gray scale conversion unit 224_2. The high gray scale conversion unit 224_1 of the second conversion unit 224 converts the intermediate data signal IDA into a first static data signal SDA1 corresponding to a high gray scale curve, e.g., the high gray scale curve HGC shown in FIG. 7. The low gray scale conversion unit 224_2 of the second conversion unit 224 converts the intermediate data signal IDA into a second static data signal SDA2 corresponding to a low gray scale curve, e.g., the low gray scale curve LGC shown in FIG. 7.

The second selector 225 includes first and second sub-selectors 225_1 and 225_2. The first sub-selector 225_1 outputs one of the intermediate data signal IDA and the first static data signal SDA1 as a first data signal DATA1 in response to the selection signal SEL from the image determination unit 226. The second sub-selector 225_2 outputs one of the intermediate data signal IDA and the second static data signal SDA2 as a second data signal DATA2 in response to the selection signal SEL from the image determination unit 226.

In one exemplary embodiment, for example, when the selection signal SEL has a first level, the first and second sub-selectors 225_1 and 225_2 output the intermediate data signal IDA from the selector 223 as the first data signal DATA1 and the second data signal DATA2. Thus, when the first image signal RGB1 is a moving picture, the timing controller 220 outputs first and second data signals DATA1 and DATA2 corresponding to one of the high and low gray scale curves HGC and LGC, alternately every frame.

When the selection signal SEL has a second level, the first sub-selector 225_1 outputs the first static data signal SDA1 from the high gray scale conversion unit 224_1 of the second conversion unit 224 as the first data signal DATA1, and the second sub-selector 225_2 outputs the second static data signal SDA2 from the low gray scale conversion unit 224_2 of the second conversion unit 224 as the second data signal DATA2. Thus, when the first image signal RGB1 is a still image, the timing controller 220 outputs a first data signal DATA1 corresponding to the high gray scale curve HGC and outputs a second data signal DATA2 corresponding to the low gray scale curve LGC.

Figure 13:
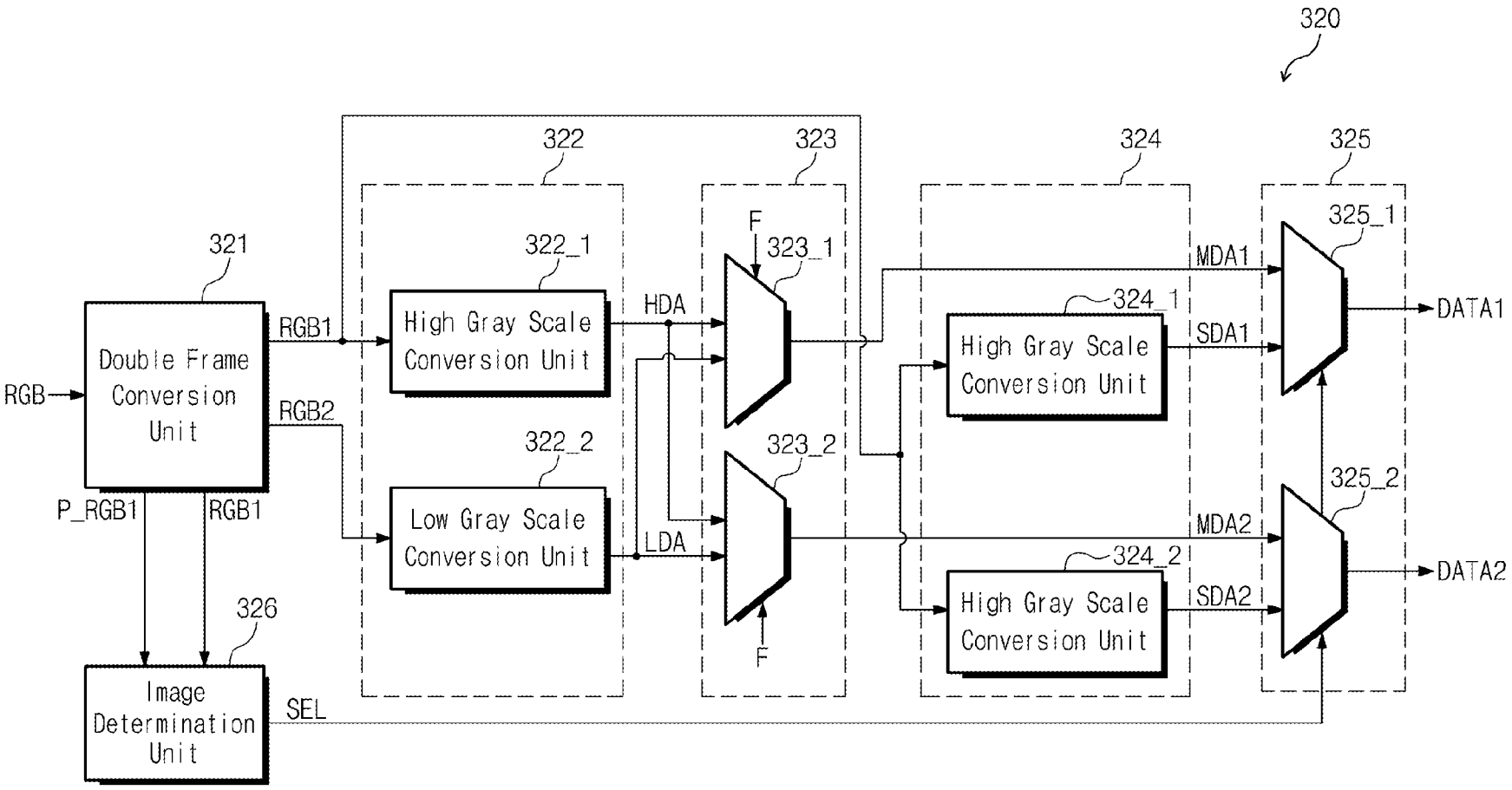
FIG. 13 is a block diagram schematically illustrating another alternative exemplary embodiment of a timing controller shown in FIG. 1, according to the invention.

FIG. 13 is a block diagram schematically illustrating another alternative exemplary embodiment of a timing controller shown in FIG. 1, according to the invention.

Referring to FIG. 13, a timing controller 320 includes a double frame conversion unit 321, a first conversion unit 322, a first selector 323, a second conversion unit 324, a second selector 325 and an image determination unit 326.

The double frame conversion unit 321 converts an image signal RGB input from an external device into a first image signal RGB1 and a second image signal RGB2. The first image signal RGB1 and the second image signal RGB2 are substantially the same as the image signal RGB, and frequencies of the first image signal RGB1 and the second image signal RGB2 are about twice that the frequency of the image signal RGB. In one exemplary embodiment, for example, a frequency of the image signal RGB is about 60 Hz, and each of the first image signal RGB1 and the second image signal RGB2 has a frequency of about 120 Hz.

The first conversion unit 322 includes a high gray scale conversion unit 322_1 and a low gray scale conversion unit 322_2. The high gray scale conversion unit 322_1 of the first conversion unit 322 converts a first image signal RGB1 into a high gray scale signal HDA corresponding to a high gray scale curve, e.g., the high gray scale curve HGC shown in FIG. 7. The low gray scale conversion unit 322_2 of the first conversion unit 322 converts a second image signal RGB2 into a low gray scale signal LDA corresponding to a low gray scale curve, e.g., the low gray scale curve LGC shown in FIG. 7.

The first selector 323 receives the high gray scale signal HDA and the low gray scale signal LDA and outputs a first dynamic data signal MDA1 and a second dynamic data signal MDA2 in response to a frame signal F. In an exemplary embodiment, as shown in FIG. 13, the first selector 323 includes first and second sub-selectors 323_1 and 323_2. The first selector 323_1 of the first selector 323 outputs the high gray scale signal HDA from the high gray scale conversion unit 322_1 of the first conversion unit 322 or the low gray scale signal LDA from the low gray scale conversion unit 322_2 of the first conversion unit 322 as the first dynamic data signal MDA1 in response to the frame signal F. The second sub-selector 323_2 of the first selector 323 outputs the high gray scale signal HDA from the high gray scale conversion unit 322_1 of the first conversion unit 322 or the low gray scale signal LDA from the low gray scale conversion unit 322_2 of the first conversion unit 322 as the second dynamic data signal MDA2 in response to the frame signal F.

Thus, the first sub-select 323_1 of the first selector 323 alternately outputs one of the high gray scale signal HDA and the low gray scale signal LDA as the first dynamic data signal MDA1 every frame, and the second sub-selector 323_2 of the first selector 323 alternately outputs one of the high gray scale signal HDA and the low gray scale signal LDA as the second dynamic data signal MDA2 every frame.

The second conversion unit 324 includes a high gray scale conversion unit 324_1 and a low gray scale conversion unit 324_2. The high gray scale conversion unit 324_1 of the second conversion unit 324 converts the first image signal RGB1 into a first static data signal SDA1 corresponding to a high gray scale curve, e.g., the high gray scale curve HGC shown in FIG. 7. The low gray scale conversion unit 324_2 of the second conversion unit 324 converts the first image signal RGB1 into a second static data signal SDA2 corresponding to a low gray scale curve, e.g., the low gray scale curve LGC shown in FIG. 7.

The image determination unit 326 compares a first image signal RGB1 of a current frame with a first image signal P_RGB1 of a previous frame and outputs a selection signal SEL based on the result of comparison. In one exemplary embodiment, for example, when the first image signal RGB1 of the current frame is different from the first image signal P_RGB1 of the previous frame, the image determination unit 326 determines the first image signal RGB1 of the current frame as a moving picture and outputs the selection signal SEL having a first level. When the first image signal RGB1 of the current frame is substantially equal to the first image signal P_RGB1 of the previous frame, the image determination unit 326 determines the first image signal RGB1 of the current frame as a still image and outputs the selection signal SEL having a second level.

The second selector 325 includes first and second sub-selectors 325_1 and 325_2. The first sub-selector 325_1 of the second selector 325 outputs one of the first dynamic data signal MDA1 and the first static data signal SDA1 as first data signal DATA1 in response to the selection signal SEL from the image determination unit 326. The second sub-selector 325_2 of the second selector 325 outputs one of the second dynamic data signal MDA2 and the second static data signal SDA2 as second data signal DATA2 in response to the selection signal SEL from the image determination unit 326.

In one exemplary embodiment, for example, when the selection signal SEL has a first level, the first and second sub-selectors 325_1 and 325_2 of the second selector 325 output the first dynamic data signal MDA1 as the first data signal DATA1 and the second dynamic data signal MDA2 as the second data signal DATA2. Thus, when the first image signal RGB1 is a moving picture, the timing controller 320 outputs the first data signal DATA1 corresponding to one of the high and low gray scale curves HGC and LGC and the second data signal DATA2 corresponding to one of the high and low gray scale curves HGC and LGC, alternately every frame.

When the selection signal SEL has a second level, the first sub-selector 325_1 of the second selector 325 outputs the first static data signal SDA1 from the high gray scale conversion unit 324_1 of the second conversion unit 324 as the first data signal DATA1, and the second sub-selector 325_2 of the second selector 325 outputs the second static data signal SDA2 from the low gray scale conversion unit 324_2 of the second conversion unit 324 as the second data signal DATA2. Thus, when the first image signal RGB1 is a still image, the timing controller 320 outputs a first data signal DATA1 corresponding to the high gray scale curve HGC and outputs a second data signal DATA2 corresponding to the low gray scale curve LGC.

Figure 14:
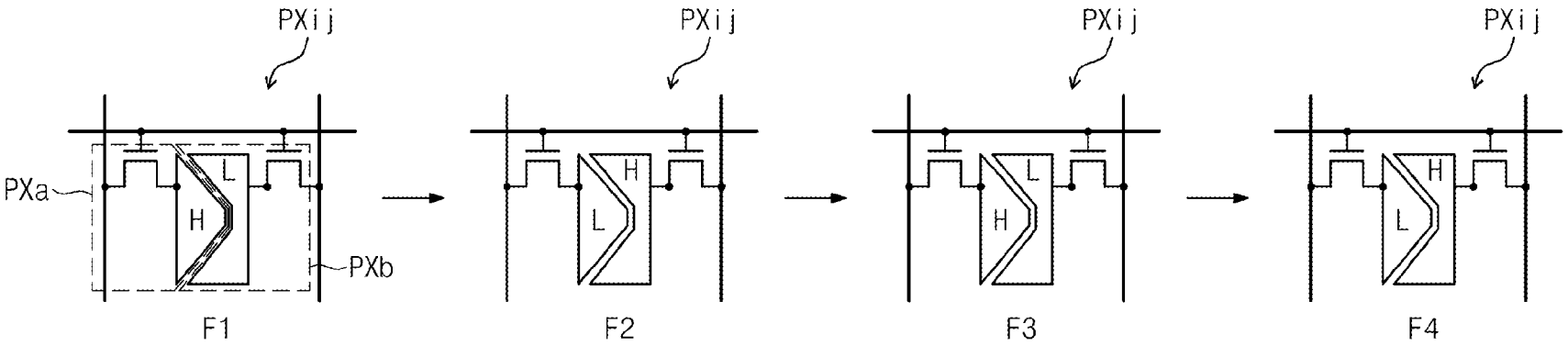
FIG. 14 is a diagram showing a first data signal and a second data signal provided to a predetermined pixel in an exemplary embodiment of a display panel when an image signal is a moving picture, according to the invention.

FIG. 14 is a diagram showing a first data signal and a second data signal provided to a predetermined pixel in an exemplary embodiment of a display panel when an image signal is a moving picture, according to the invention.

Referring to FIGS. 13 and 14, an image determination unit 326 compares a first image signal RGB1 of a current frame with a first image signal P_RGB1 of a previous frame and output a selection signal SEL. In one exemplary embodiment, for example, when the first image signal RGB1 of the current frame is different from the first image signal P_RGB1 of the previous frame, the image determination unit 326 determines the first image signal RGB1 of the current frame as a moving picture and outputs the selection signal SEL having a first level. The second selector 325 outputs first and second dynamic data signals MDA1 and MDA2 from the first selector 323 as first and second data DATA1 and DATA2 in response to the selection signal SEL having the first level.

In odd-numbered frames F1 and F3, the first sub-selector 323_1 of the first selector 323 outputs the high gray scale signal HDA from a high gray scale conversion unit 322_1 of the first conversion unit 322 as the first dynamic data signal MDA1. In even-numbered frames F2 and F4, the selector 323_1 outputs a low gray scale signal LDA from the low gray scale conversion unit 322_2 of the first conversion unit 322 as the first dynamic data signal MDA1.

In the odd-numbered frames F1 and F3, the second sub-selector 323_2 of the first selector 323 outputs a low gray scale signal LDA from the low gray scale conversion unit 322_2 of the first conversion unit 322 as the second dynamic data signal MDA2. In the even-numbered frames F2 and F4, the selector 323_1 outputs a high gray scale signal HDA from the high gray scale conversion unit 322_1 of the first conversion unit 322 as the second dynamic data signal MDA2.

Therefore, a first sub-pixel PXa of a pixel PXij displays an image of brightness corresponding to the high gray scale curve HGC and the low gray scale curve LGC alternately every frame, and a second sub-pixel PXb of the pixel PXij displays an image of brightness corresponding to the high gray scale curve HGC and the low gray scale curve LGC, alternately every frame.

The high gray scale curve HGC corresponds to brightness that provides high visibility at a side of a display panel 110, the low gray scale curve LGC corresponds to brightness that provides high visibility at a front of the display panel 110.

In such an embodiment, a variation in visibility according to a location of a viewer is reduced by providing the first and second sub-pixels PXa and PXb with the first and second data signals DATA1 and DATA2 corresponding to the high gray scale curve HGC and the low gray scale curve LGC, alternately every frame, such that the visibility of a display device 100 is substantially improved. In such an embodiment, lateral visibility of the display panel 110 is further improved by providing the first and second sub-pixels PXa and PXb with the first and second data signals DATA1 and DATA2 corresponding to different gray scale curves such that visibility of a display apparatus 100 is substantially improved.

Figure 15:
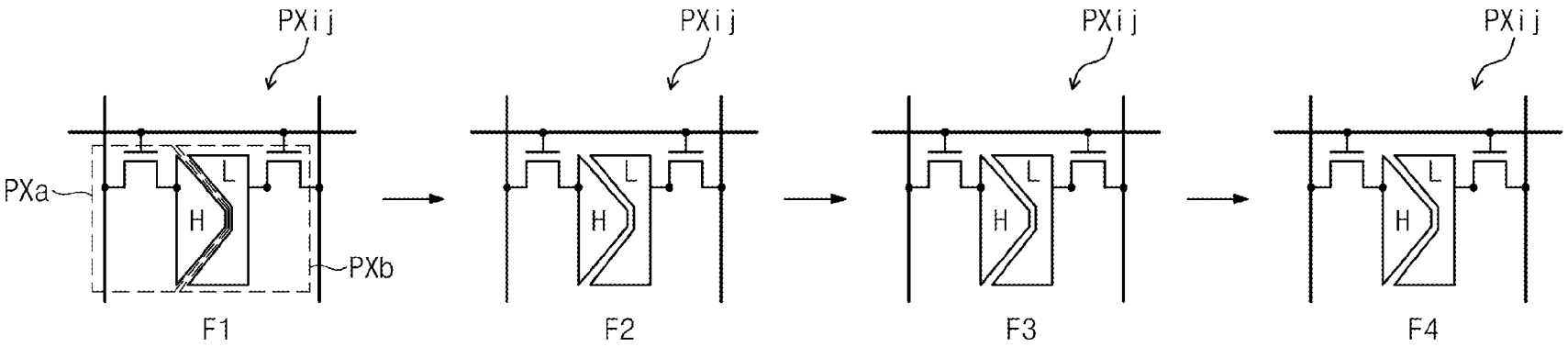
FIG. 15 is a diagram for describing a first data signal and a second data signal provided to a predetermined pixel in an exemplary embodiment of a display panel when an image signal is a still image, according to the invention.

FIG. 15 is a diagram showing a first data signal and a second data signal provided to a predetermined pixel in an exemplary embodiment of a display panel when an image signal is a still image, according to the invention.

Referring to FIGS. 13 and 15, the image determination unit 326 compares a first image signal RGB1 of a current frame with a first image signal P_RGB1 of a previous frame and output a selection signal SEL. In one exemplary embodiment, for example, when the first image signal RGB1 of the current frame is substantially equal to the first image signal P_RGB1 of the previous frame, the image determination unit 326 determines the first image signal RGB1 of the current frame as a still image and outputs the selection signal SEL having a second level. A selector 325 outputs first and second static data signals SDA1 and SDA2 from a second conversion unit 324 as first and second data DATA1 and DATA2 in response to the selection signal SEL having the second level.

The second conversion unit 324 converts a first image signal into the first static data signal SDA1 corresponding to a high gray scale curve, e.g., the high gray scale curve HGC shown in FIG. 7 and a second image signal RGB2 into the second static data signal SDA2 corresponding to a low gray scale curve, e.g., the low gray scale curve LGC shown in FIG. 7.

Thus, a first sub-pixel PXa of a pixel PXij displays an image of brightness corresponding to the high gray scale curve HGC and the low gray scale curve LGC, and a second sub-pixel PXb of the pixel PXij displays an image of brightness corresponding to the high gray scale curve HGC and the low gray scale curve LGC. When a still image is received, the first sub-pixel PXa and the second sub-pixel PXb of the pixel PXij simultaneously display an image of brightness corresponding to the high gray scale curve HGC and an image of brightness corresponding to the low gray scale curve LGC. Thus, visibility of a display panel 110 is substantially improved and an occurrence of a flicker is effectively prevented.

Figure 16:
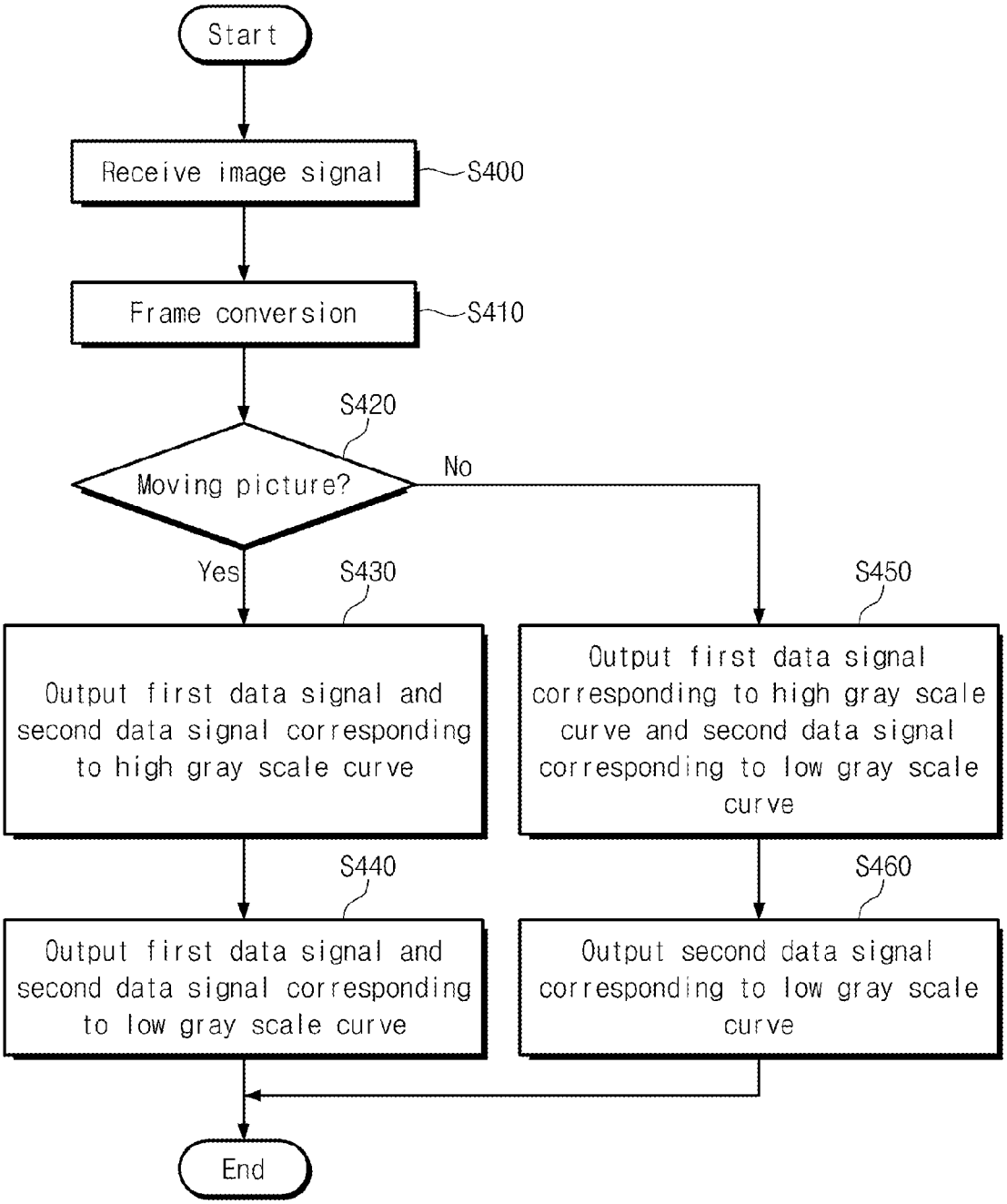
FIG. 16 is a flow chart showing an exemplary embodiment of a method of driving a display apparatus, according to the invention.

FIG. 16 is a flow chart showing an exemplary embodiment of a method of driving a display apparatus, according to the invention. For ease of description, an operation of a display apparatus will be described with reference to FIG. 16 and back to FIGS. 2 and 4.

Referring to FIGS. 2, 4 and 16, the timing controller 120 in a display apparatus receives an image signal RGB from an external device (S400). A double frame conversion unit 121 of the timing controller 120 converts the image signal RGB into a first image signal RGB1 and a second image signal RGB2 (S410). The first image signal RGB1 and the second image signal RGB2 are substantially the same as the image signal RGB, and frequencies of the first image signal RGB1 and the second image signal RGB2 are about twice that the frequency of the image signal RGB. In one exemplary embodiment, for example, a frequency of the image signal RGB is about 60 Hz, and each of the first image signal RGB1 and the second image signal RGB2 has a frequency of about 120 Hz.

An image determination unit 125 of the timing controller 120 compares a first image signal RGB1 of a current frame with a first image signal P_RGB1 of a previous frame and outputs a selection signal SEL based on the result of comparison. In one exemplary embodiment, for example, when the first image signal RGB1 of the current frame is different from the first image signal P_RGB1 of the previous frame, the image determination unit 125 determines the first image signal RGB1 of the current frame as a moving picture. When the first image signal RGB1 of the current frame is substantially equal to the first image signal P_RGB1 of the previous frame, the image determination unit 125 determines the first image signal RGB1 of the current frame as a still image.

When it is determined that the first image signal RGB1 is a moving picture, first and second dynamic data signals MDA1 and MDA2 output from a first conversion unit 122 of the timing controller 120 are selected as first and second data signals DATA1 and DATA2. The first dynamic data signal MDA1 is a signal corresponding to a high gray scale curve, e.g., the high gray scale curve HGC shown in FIG. 7, and the second dynamic data signal MDA2 is a signal corresponding to a low gray scale curve, e.g., the low gray scale curve LGC shown in FIG. 7.

When it is determined that the first image signal RGB1 is a moving picture, the first and second dynamic data signals MDA1 and MDA2 output from the first conversion unit 122 are selected as the first and second data signals DATA1 and DATA2. In an odd-numbered frame, the first and second dynamic data signal MDA1 and MDA2 are signals corresponding to the high gray scale curve, e.g., the high gray scale curve HGC shown in FIG. 7. In an even-numbered frame, the first and second dynamic data signal MDA1 and MDA2 are signals corresponding to the low gray scale curve, e.g., the low gray scale curve LGC shown in FIG. 7.

Therefore, the timing controller 120 outputs the first and second data signals DATA1 and DATA2 corresponding to the high gray scale curve HGC in the odd-numbered frame (S430). The timing controller 120 outputs the first and second data signals DATA1 and DATA2 corresponding to the low gray scale curve LGC in the even-numbered frame (S440).

The high gray scale curve HGC corresponds to brightness that provides high visibility at a side of a display panel 110, and the low gray scale curve LGC corresponds to brightness that provides high visibility at a front of the display panel 110. Thus, a variation in visibility according to a location of a viewer is substantially reduced by providing first and second sub-pixels PXa and PXb with the first and second data signals DATA1 and DATA2 corresponding to the high gray scale curve HGC and the low gray scale curve LGC, alternately every frame. Accordingly, in such an embodiment, the visibility of a display device 100 is substantially improved.

When it is determined that the first image signal RGB1 is a still image, first and second static data signals SDA1 and SDA2 output from a second conversion unit 123 are selected as the first and second data signals DATA1 and DATA2. The first static data signal SDA1 is a signal corresponding to the high gray scale curve HGC, and the second static data signal SDA2 is a signal corresponding to the low gray scale curve LGC.

Therefore, in an odd-numbered frame, the timing controller 120 outputs the first data signal DATA1 corresponding to the high gray scale curve HGC and the second data signal DATA2 corresponding to the low gray scale curve LGC (S450). In an even-numbered frame, the timing controller 120 outputs the second data signal DATA2 corresponding to the low gray scale curve LGC (S460).

Accordingly, in such an embodiment, a flicker phenomenon is effectively prevented by providing the first sub-pixel PXa with the first data signal DATA1 corresponding to the high gray scale curve HGC and the second sub-pixel PXb with the second data signal DATA2 corresponding to the low gray scale curve LGC when the first image signal RGB1 is a still image.

While the invention has been described with reference to exemplary embodiments, it will be apparent to those skilled in the art that various changes and modifications may be made without departing from the spirit and scope of the present invention. Therefore, it should be understood that the above embodiments are not limiting, but illustrative.

What is claimed is:

1. A display apparatus, comprising:

a display panel comprising a plurality of pixels connected to a plurality of gate lines and a plurality of data lines, wherein each pixel comprises a first sub-pixel and a second sub-pixel;

a gate driver configured to drive the plurality of gate lines;

a data driver configured to drive the plurality of data lines; and a timing controller configured to control the gate driver and the data driver and to output a first data signal and a second data signal for the first sub-pixel and the second sub-pixel, respectively, in response to an image signal, wherein when the image signal is a first type of image signal, both of the first data signal and the second data signal correspond to one of a high gray scale curve and a low gray scale curve lower than the high gray scale curve, alternately every frame;

wherein when the image signal is a second type of image signal, the first data signal corresponds to the high gray scale curve and the second data signal corresponds to the low gray scale curve, and wherein the timing controller determines the image signal as the first type of image signal when an image signal of a previous frame is different from an image signal of a current frame, and the timing controller determines the image signal as the second type of image signal when the image signal of the previous frame is substantially equal to the image signal of the current frame.

2. The display apparatus of claim 1, wherein the timing controller comprises:

a first conversion unit configured to convert the image signal into a first dynamic data signal and a second dynamic data signal corresponding to the high gray scale curve and the low gray scale curve;

a second conversion unit configured to convert the image signal into a first static data signal and a second static data signal corresponding to the high gray scale curve and the low gray scale curve;

an image determination unit configured to compare the image signal of the previous frame and the image signal of the current frame and to output a selection signal corresponding to a result of comparison; and a selection circuit configured to receive the first and second dynamic data signals and the first and second static data signals and to output the first and second data signals in response to the selection signal.

3. The display apparatus of claim 2, wherein the first conversion unit outputs the first and second dynamic data signals corresponding to the high gray scale curve during a first frame of two consecutive frames, and the first conversion unit outputs the first and second static data signals corresponding to the high gray scale curve during a second frame of the two consecutive frames.

4. The display apparatus of claim 2, wherein the second conversion unit outputs the first static data signal corresponding to the high gray scale curve and the second static data signal corresponding to the low gray scale curve.

5. The display apparatus of claim 2, wherein the first conversion unit comprises:

a high gray scale conversion unit configured to receive the image signal and to output a high gray scale signal corresponding to the high gray scale curve;

a low gray scale conversion unit configured to receive the image signal and to output a low gray scale signal corresponding to the low gray scale curve; and a selector configured to output one of the high gray scale signal and the low gray scale signal as the first dynamic data signal and the second dynamic data signal every frame.

6. The display apparatus of claim 2, wherein the second conversion unit comprises:

a high gray scale conversion unit configured to receive the image signal and to output the first static data signal corresponding to the high gray scale curve; and a low gray scale conversion unit configured to receive the image signal and to output a second static data signal corresponding to the low gray scale curve.

7. The display apparatus of claim 1, wherein the timing controller compares the image signal of the current frame and the image signal of the previous frame on a pixel-by-pixel basis.

8. The display apparatus of claim 1, wherein the timing controller comprises:

a double frame conversion unit configured to convert the image signal into a first image signal and a second image signal;

a first conversion unit configured to convert the first image signal and the second image signal into a dynamic data signal corresponding to the high gray scale curve and the low gray scale curve, alternately every frame;

a first selector configured to select one of the first image signal and the dynamic data signal as an intermediate data signal in response to a selection signal;

a second conversion unit configured to convert the intermediate data signal into a first static data signal corresponding to the high gray scale curve and a second static data signal corresponding to the low gray scale signal;

a second selector configured to receive the first and second static data signals and the intermediate data signal and to output the first data signal and the second data signal in response to the selection signal.

9. The display apparatus of claim 8, wherein the first conversion unit comprises:

a high gray scale conversion unit configured to receive the first image signal and to output a high gray scale signal corresponding to the high gray scale curve;

a low gray scale conversion unit configured to receive the second image signal and to output a low gray scale signal corresponding to the low gray scale curve; and a third selector configured to output one of the high gray scale signal and the low gray scale signal as the dynamic data signal every frame.

10. The display apparatus of claim 8, wherein the second conversion unit comprises:

a high gray scale conversion unit configured to receive the intermediate data signal and to output the first static data signal corresponding to the high gray scale curve; and a low gray scale conversion unit configured to receive the intermediate data signal and to output the second static data signal corresponding to the low gray scale curve.

11. The display apparatus of claim 1, wherein the timing controller comprises:

a double frame conversion unit configured to convert the image signal into a first image signal and a second image signal;

a first conversion unit configured to convert the first image signal and the second image signal into a first dynamic data signal and a second dynamic data signal;

a second conversion unit configured to convert the first image signal and the second image signal into a first static data signal corresponding to the high gray scale curve and a second static data signal corresponding to the low gray scale signal; and a selector configured to receive the first and second dynamic data signals and the first and second static data signals and to output the first data signal and the second data signal in response to a selection signal.

12. The display apparatus of claim 11, wherein the first conversion unit comprises:

a high gray scale conversion unit configured to receive the first image signal and to output a high gray scale signal corresponding to the high gray scale curve;

a low gray scale conversion unit configured to receive the second image signal and to output a low gray scale signal corresponding to the low gray scale curve; and an output unit configured to output the high gray scale signal and the low gray scale signal as the first dynamic data signal and the second dynamic data signal, wherein during a first frame of two consecutive frames, the output unit outputs the high gray scale signal as the first dynamic data signal and the low gray scale signal as the second dynamic data signal, and wherein during a second frame of the two consecutive frames, the output unit outputs the low gray scale signal as the first dynamic data signal and the high gray scale signal as the second dynamic data signal.

13. The display apparatus of claim 1, wherein the first and second sub-pixels of each pixel are connected to a same gate line of the plurality of gate lines and connected to two different data lines of the plurality of data lines, respectively.

14. The display apparatus of claim 13, wherein the first sub-pixel comprises:

a first transistor connected between a first data line of the two different data lines and a first node, and comprising a gate connected to the same gate line; and a liquid crystal capacitor connected between the first node and a common voltage.

15. The display apparatus of claim 13, wherein the second sub-pixel comprises:

a second transistor connected between a second data line of the two different data lines and a second node, and comprising a gate connected to the same gate line; and a liquid crystal capacitor connected between the second node and a common voltage.

* * * * *